US006068785A

United States Patent [19]

Raj et al.

[11] Patent Number: 6,068,785

[45] Date of Patent: May 30, 2000

[54] METHOD FOR MANUFACTURING OIL-BASED FERROFLUID

[75] Inventors: Kuldip Raj, Merrimack; Lutful M. Aziz, Nashua, both of N.H.; Ronald E. Rosensweig, Summit, N.J.

[73] Assignee: Ferrofluidics Corporation, Nashua, N.H.

[21] Appl. No.: 09/021,229

[22] Filed: Feb. 10, 1998

[51] Int. Cl.[7] ..... H01F 1/44

[52] U.S. Cl. ..... 252/62.52; 252/62.56; 252/62.54

[58] Field of Search ..... 252/62.52, 62.56, 252/62.54

[56] References Cited

U.S. PATENT DOCUMENTS

| | | | |
|---|---|---|---|
| 3,215,572 | 11/1965 | Papell | 252/62.52 |
| 3,531,413 | 9/1970 | Rosensweig | 252/62.52 |
| 3,764,540 | 10/1973 | Khalafalia et al. | 252/62.52 |
| 4,329,241 | 5/1982 | Massart | 252/62.52 |
| 4,834,898 | 5/1989 | Hwang . | |
| 4,976,883 | 12/1990 | Kanno et al. | 252/62.52 |

FOREIGN PATENT DOCUMENTS

| | | |
|---|---|---|
| 2498587 | 7/1982 | France . |
| 04335502 | 11/1992 | Japan . |

OTHER PUBLICATIONS

Chemical Abstract Citation 84:68840: Uehara, "Structural Changes of Iron Oxides by Ball Milling in Different Media", Bull. Chem. Soc. Jpn. vol. 48, No. 11, pp. 3383–3384, 1975, no month.

Magnetic Fluid Applications Handbook, editor in–chief: B. Berkovsky, Begell House, Inc., New York (1996), no month.

Ferrohydrodynamics, R.E. Rosensweig, Cambridge University Press, New York (1985), no month.

Ferromagnetic Materials vol. 2—A Handbook on the Properties of Magnetically Ordered Substances, editor E.P. Wohlfarth, Chapter 8, North–Holland Publishing Company, 1980, no month.

Journal of Magnetism and Magnetic Materials 149 (1995) 1–5, no month.

Ferrohydrodynamic Fluids for Direct Conversion of Heat Energy, Proc. Symp. A.I.Ch.E.–I. Chem.E. Ser. 5, pp. 104–118, discussion, pp. 133–137 (1965), no month.

Grabovskii et al.; Water–Base Magnetic Liquid; 6001 Chemical Abstracts; Columbus, Ohio; Jun. 1984; p. 672, vol.: 100, No. 26, col. 1; XP002072837, USSR.

M.A. Berlin et al.; Ferromagnetic Liquid and Method for Preparing It; 6001 Chemical Abstracts; Columbus, Ohio; Nov. 1982; p. 754, vol.: 97, No. 20, col. 1; XP002072838, USSR.

*Primary Examiner*—C. Melissa Koslow
*Attorney, Agent, or Firm*—Kudirka & Jobse, LLP

[57] ABSTRACT

A slurry is formed of particles of a non-magnetic oxide of iron ($\alpha$-$Fe_2O_3$), an oil carrier liquid and a surfactant. The slurry is then processed in an attrition mill where kinetic energy is applied to the slurry to convert the $\alpha$-$Fe_2O_3$ particles to magnetic iron oxide particles to form an oil-based ferrofluid. In order to increase the saturation magnetization of the resulting ferrofluid, a beneficial agent is brought into contact with the slurry during processing in the attrition mill. The beneficial agent can be a magnetic material, such as elemental iron, or can be water. A ferrofluid can also be formed by creating a powder of surfactant-coated magnetic particles and using an attrition mill to coat the particles with a second surfactant and suspend the coated particles in a carrier liquid.

14 Claims, 2 Drawing Sheets

METHOD FOR MANUFACTURING OIL-BASED FERROFLUID

FIELD OF THE INVENTION

This invention relates to an improved process for making stable ferrofluids utilizing hydrocarbon liquids as carriers.

BACKGROUND OF THE INVENTION

Magnetic liquids, which are commonly referred to as "ferrofluids", typically comprise a colloidal dispersion of finely-divided magnetic particles, such as iron, $\gamma$-$Fe_2O_3$, magnetite and combinations thereof, of subdomain size (for example, 10 to 300 Angstroms) in a liquid carrier. The dispersion of the particles is maintained in the liquid carrier by a surfactant which coats the particles. Due to the thermal motion (Brownian movement) of the coated particles in the carrier, the particles are remarkably unaffected by the presence of an applied magnetic field or other force fields, such as centrifugal or gravitational fields, and remain uniformly dispersed throughout the liquid carrier even in the presence of such fields.

A typical ferrofluid may consist of the following volume fractions: 4% particles, 8% surfactant and 88% liquid carrier. Ferrofluids are often named for the liquid carrier in which the particles are suspended because it is the dominant component. For example, a water-based ferrofluid is a stable suspension of magnetic particles in water, whereas an oil-based ferrofluid is a stable suspension of magnetic particles in an oil (such as a hydrocarbon, an ester, a fluorocarbon, a silicone oil or polyphenyl ether, etc.) In addition, as mentioned above, the surfactants for water- and oil-based ferrofluids are different.

Ferrofluid compositions are widely known, and typical ferrofluid compositions are described, for example, in U.S. Pat. No. 3,531,413. The magnetic particles which form a ferrofluid typically are comprised of an iron oxide. Oxide ferrofluids are highly stable in contact with the atmosphere, although ferrofluids containing metallic particles of Fe, Ni, Co and alloys thereof are also known in the art. Such ferrofluids compositions are utilized in a wide variety of applications, including audio voice-coil dampening, voice-coil cooling, inertia dampening, stepper motors, noise control and vacuum device seals. Other applications pertain to material separation processes and the cooling of electrical equipment.

A number of books and references discuss the science of magnetic fluids, including their preparation. These references include: *Magnetic Fluid Applications Handbook,* editor in-chief: B. Berkovsky, Begell House Inc., New York (1996); Ferrohydrodynamics, R. E. Rosensweig, Cambridge University Press, New York (1985); *Ferromagnetic Materials-A Handbook on the Properties of Magnetically Ordered Substances,* editor E. P. Wohlfarth, Chapter 8, North-Holland Publishing Company, New York and "Proceedings of the $7^{th}$ International Conference on Magnetic Fluids", *Journal of Magnetism and Magnetic Materials,* Vol. 149, Nos. 1–2 (1995).

Ferrofluids were originally manufactured by grinding magnetic materials in the presence of a solvent, such as a normal alkane, and a surfactant, such as oleic acid.

Typical manufacturing processes for these ferrofluids are described in U.S. Pat. No. 3,215,572 and in an article entitled "Ferrohydrodynamic Fluids for Direct Conversion of Heat Energy", R. E. Rosensweig, J. W. Nestor and R. S. Timmins, *Materials Associated with direct Energy Conversion, Proc. Symp. AIChE-IChemE,* Ser. 5, pp. 104–118, discussion, pp. 133-137 (1965). In these ferrofluids, the magnetic particles are prevented from agglomerating by the mechanism of steric repulsion, which mechanism is well-known to one skilled in colloid science.

The grinding operation is conventionally carried out in a ball mill. However, a conventional ball milling operation takes anywhere from two to six weeks to complete.

The colloid formed by this process generally includes uncoated particles and large aggregates and thus requires a subsequent refinement in which undesirable particles and aggregates are removed. Moreover, the finished product often has a high viscosity due to the presence of small particles produced during the grinding process. Consequently, the yield is poor, preparation times are long and the associated costs are high.

Ferrofluids can also be manufactured by chemical precipitation as disclosed in U.S. Pat. No. 3,764,540. The ferrofluids produced in this latter manner are sterically stabilized with adsorbed surfactant. Another manufacturing process is disclosed in U.S. Pat. No. 4,329,241 which illustrates ferrofluid synthesis in an aqueous medium of particles stabilized by charge repulsion.

However, chemically-precipitated ferrofluid manufacturing techniques create chemical waste, comprising un-reacted metal salt solutions and uncoated particles in aqueous and nonaqueous media which must be disposed of in proper compliance with environmental regulations. The waste removal adds to the cost of manufacturing the ferrofluids.

U.S. Pat. No. 3,764,540 discloses ferrofluid compositions comprising stable suspensions of magnetite and elemental iron and a method for their manufacture. The disclosed manufacturing method involves comminuting a non-magnetic or an anti-magnetic precursor material to colloidal size and dispersing the comminuted precursor in a carrier fluid. Thereafter, the precursor material is converted to a ferromagnetic form. The disclosed precursor material is a sub-oxide of iron (called a Wustite composition) having the formula $Fe_{1-x}O$ wherein x has a value of 0.01 to 0.20. Conversion of this precursor material to a ferromagnetic material is accomplished by heating the colloidal mixture to temperatures in the range of about 200–570° C.

A co-pending patent application, filed on Feb. 10, 1998, by Kuldip Raj and Lutful Aziz and assigned Ser. No. 09/021,228, now U.S. Pat. No. 5,958,282, describes the production of low-cost magnetic fluids utilizing water as a carrier liquid. In accordance with the disclosure of that application, a mixture of non-magnetic iron oxide particles ($\alpha$-$Fe_2O_3$ ), deionized water and surfactant is ground in an attritor mill with the surprising result that a stable, magnetic colloidal dispersion is obtained after a short period of grinding.

However, water-based ferrofluids are not suitable for many applications. Accordingly, there is a need for a process which produces an inexpensive oil-based ferrofluid which can quickly be manufactured in large volumes. It is further desirable that the ferrofluid be produced with a process that generates little or no waste and is not labor intensive.

SUMMARY OF THE INVENTION

In accordance with the principles of this invention, a slurry is formed of particles of a non-magnetic oxide of iron ($\alpha$-$Fe_2O_3$), an oil carrier liquid and a surfactant. The slurry is then processed in an attrition mill where kinetic energy is applied to the slurry to convert the $\alpha$-$Fe_2O_3$ particles to magnetic iron oxide particles to form an oil-based ferrofluid.

In order to increase the saturation magnetization of the resulting ferrofluid, a "beneficial agent" is brought into contact with the slurry during processing in the attrition mill.

In accordance with one illustrative embodiment, the beneficial agent is a magnetic material. For example, the attrition mill can be charged with carbon steel grinding balls which provide the magnetic material beneficial agent for converting the $\alpha$-$Fe_2O_3$ particles to magnetic iron oxide particles. In accordance with other embodiments, small amounts of a magnetic materials, such as iron powder, are added to the slurry during processing to serve as a beneficial agent for converting the $\alpha$-$Fe_2O_3$ particles to magnetic iron oxide particles.

In accordance with another embodiment, water is added to the oil-based slurry to act as a beneficial agent for converting the $\alpha$-$Fe_2O_3$ particles to magnetic iron oxide particles. The water decreases the viscosity of the slurry and speeds up the grinding process.

In accordance with yet another embodiment, an attrition mill process can be used to reduce the processing time required to prepare a colloid in which the suspended particles are coated with two surfactants. In accordance with this embodiment, $\alpha$-$Fe_2O_3$ particles are converted to a magnetic particles suspended in a solvent by means of the processes described above or other known processes. The solvent is then removed, for example, by drying the particles. The dried particles are then mixed with another carrier liquid and a second surfactant and placed in the attrition mill where the final doubly-coated colloid is formed. The overall process can be carried out in a much shorter time than possible with prior art processes.

BRIEF DESCRIPTION OF THE DRAWINGS

The above and further advantages of the invention may be better understood by referring to the following description in conjunction with the accompanying drawings and which.

DETAILED DESCRIPTION OF THE PREFERRED EMBODIMENT

In one embodiment of the invention, the starting material is a non-magnetic red iron oxide. The red iron oxide used in this embodiment was procured from the BASF Corporation, Mount Olive, N. J. The material is sold under the trade name of "carbonyl iron oxide red". The particle size is listed to be 10–130 nm. The apparent density of powder is 0.7–0.8 kg/I and it is insoluble in water. An X-ray diffraction pattern of the powder was generated and confirmed that it was $\alpha$-$Fe_2O_3$. When a magnet was brought close to the powder, it showed no magnetic attraction.

A set of experiments were performed using different starting mixtures and different beneficial agents. The following carrier types were used: hydrocarbon, ester, fluorocarbon, and silicone; and appropriate surfactants were selected for each of these carriers for the formation of the colloids. The resulting ferrofluids were evaluated by measuring the saturation magnetization, and viscosity and noting the color. A high quality ferrofluid has a high saturation magnetization, low viscosity and a uniform black color. Ferrofluids with low saturation magnetizations have limited uses. Using the experimental mixtures, the finished ferrofluid was either dark brown, light brown, black-brown or black in color. The dark brown, light brown and black-brown colloids were considered to be inferior products as the conversion from red iron oxide to magnetic form was believed not to be complete. These formulations generally showed a poor colloid stability when placed on a magnet, a low magnetization value and a relatively high viscosity.

The starting mixtures were processed in an attrition mill which applies a high level of shear energy to the material to convert the non-magnetic red iron oxide powder to magnetic form. Attrition mills can be purchased from a number of sources. In the examples below, a model DM 01HD attrition mill manufactured by Union Process Company, Akron, Ohio, was used. This machine is a vertical lab attritor for processing of small amounts of materials. The speed of rotation was kept at 3000 rpm, and no liquid cooling was employed. The volume of grinding media was 500 ml and consisted either of magnetic carbon steel balls (diameter 0.85 mm) or non-magnetic ceramic balls (diameter=0.65 mm). The grinding operation was carried out either for a period of 24 or 48 hours. The steady state temperature of the liquid was in the range of 90 to 120° C. The amount of $\alpha$-$Fe_2O_3$ red iron oxide used in each experiment was typically 30 gm, the volume of dispersant 20 cc and the volume of carrier liquid about 325 cc.

Figure 1:
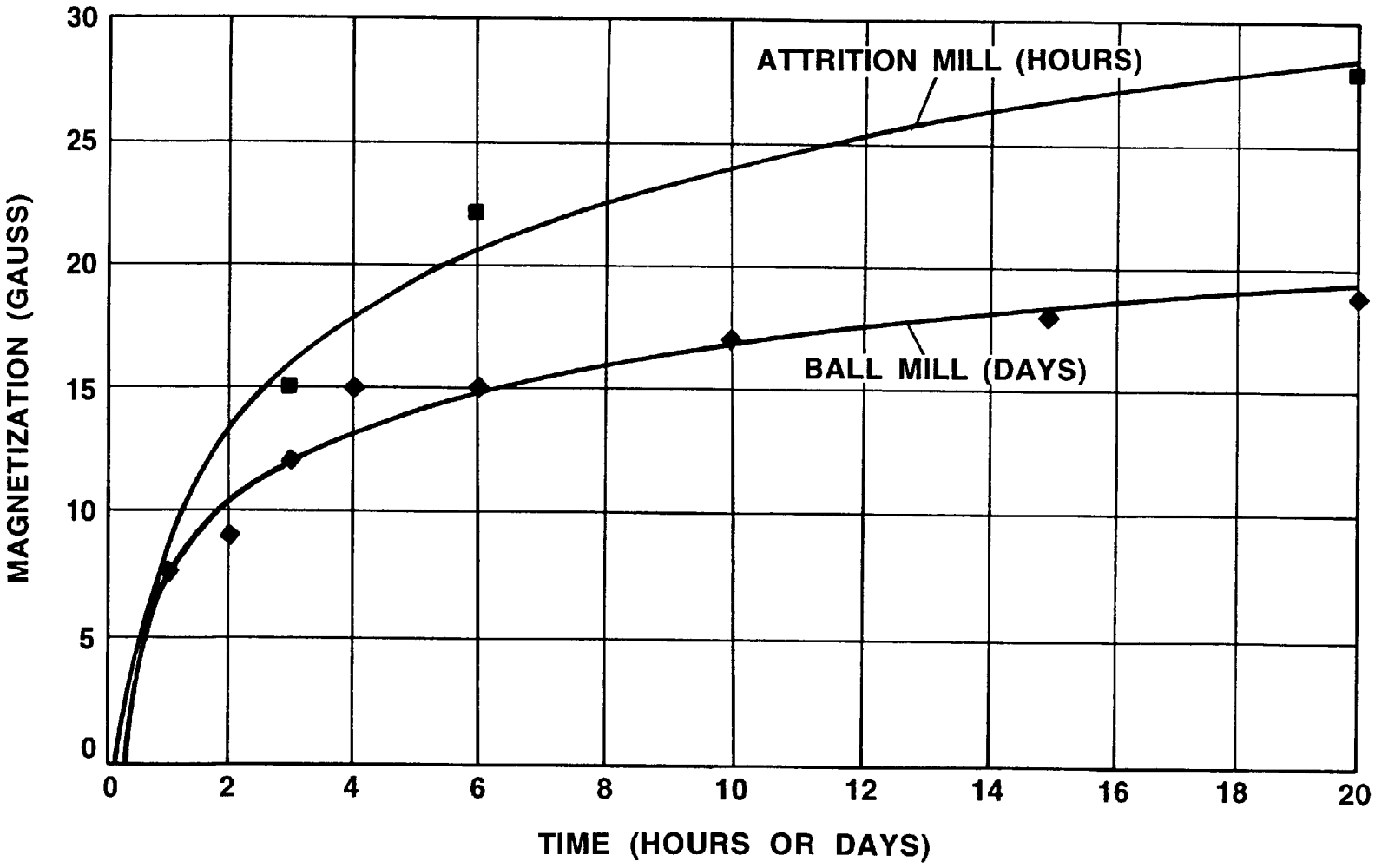
FIG. 1 is a graph illustrating a reduction in processing time when an attrition mill is used to grind the ferrofluid starting mixture in accordance with the principles of the invention as compared to the conventional use of a ball mill.

In an attrition mill, the grinding action is much more aggressive than in a ball mill. Consequently, satisfactory results can be achieved with an attrition mill in a much shorter time than with a ball mill and the use of an attrition mill is an important factor in reducing the grinding time for, and the cost of, producing the ferrofluid. As an illustration, the same oil-based ferrofluid was prepared using the aforementioned lab attritor and a conventional ball mill. The constituents of ferrofluid were used in the same proportion in both the attrition mill and the ball mill. FIG. 1 shows the results of this illustration. A stable colloid with acceptable saturation magnetization is formed much more quickly with the attritor than with the ball mill. For example, a ferrofluid with a saturation magnetization of 60 Gauss was produced in 60 minutes with the attritor, but the ball mill had to be run for about 60 hours to produce a ferrofluid with an equivalent saturation magnetization.

After running the mill for the prescribed length of time, the contents (typically 300 ml) were poured into a beaker. The fluid was filtered through a fine cloth screen to remove the grinding media balls. The fluid was then transferred into an aluminum pan and placed on a magnet for a period of up to 16 hours to remove any uncoated particles and large aggregates. The magnetization and viscosity values of this fluid was measured and reported in examples. As illustrated, the results vary depending on the grinding time and surfactent used.

The first four examples illustrate processing results with ceramic grinding media and various carrier oils and surfactants.

EXAMPLE 1

| Processing values | |
|---|---|
| $\alpha$-$Fe_2O_3$ amount: | 30 gm |
| Surfactant type: | OS25569 (polyolefin anhydride), Lubrizol |

-continued

| | |
|---|---|
| | Corporation, Wickiffe, Ohio |
| Surfactant amount: | 20 cc |
| Carrier oil: | Amprol Type II (hydrocarbon oil), Lyondell, Houston, Texas |
| Carrier oil amount: | 400 cc |
| Grinding media: | Ceramic Balls |
| Grinding duration: | 48 hours |
| Ferrofluid | |
| Magnetization: | 13 Gauss |
| Viscosity: | 16 cp |
| Color: | Dark Brown |

EXAMPLE 2

| Processing values | |
|---|---|
| $\alpha$-$Fe_2O_3$ amount: | 30 gm |
| Surfactant type: | OS11505 (alkenyl succinimide), Lubrizol Corporation, Wickiffe, Ohio |
| Surfactant amount: | 20 cc |
| Carrier oil type: | Amprol Type II (hydrocarbon oil), Lyondell, Houston, Texas |
| Carrier oil amount: | 300 cc |
| Grinding media: | Ceramic Balls |
| Grinding duration: | 46 hours |
| Ferrofluid | |
| Magnetization: | 13 Gauss |
| Viscosity: | 13 cp |
| Color: | Dark Brown |

EXAMPLE 3

| Processing values | |
|---|---|
| $\alpha$-$Fe_2O_3$ amount: | 30 gm |
| Surfactant type: | OS11505 (alkenyl succinimide), Lubrizol Corporation, Wickiffe, Ohio |
| Surfactant amount: | 20 cc |
| Carrier oil type: | Amprol Type II (hydrocarbon oil), Lyondell, Houston, Texas |
| Carrier oil amount: | 400 cc |
| Grinding media: | Ceramic Balls |
| Grinding duration: | 37 hours |
| Ferrofluid | |
| Magnetization: | 13 Gauss |
| Viscosity: | 14 cp |
| Color: | Dark Brown |

EXAMPLE 4

| Processing values | |
|---|---|
| $\alpha$-$Fe_2O_3$ amount: | 30 gm |
| Surfactant type: | OS11505 (alkenyl succinimide), Lubrizol Corporation, Wickiffe, Ohio |
| Surfactant amount: | 20 cc |
| Carrier oil type: | Amprol Type II (hydrocarbon oil), Lyondell, Houston, Texas |
| Carrier oil amount: | 400 cc |

-continued

| | |
|---|---|
| Grinding media: | Ceramic Balls |
| Grinding duration: | 37 hours |
| Ferrofluid | |
| Magnetization: | 19 Gauss |
| Viscosity: | 27 cp |
| Color: | Black-Brown |

In the above examples, the quality of the colloid was poor when non-magnetic grinding media were used in the attrition mill. In the following examples, the ceramic ball grinding media are replaced with carbon steel grinding media. Again, the results differ depending on the surfactant used and the grinding time.

EXAMPLE 5

| Processing values | |
|---|---|
| $\alpha$-$Fe_2O_3$ amount: | 30 gm |
| Surfactant: | OS25569 (polyolefin anhydride), Lubrizol Corporation, Wickiffe, Ohio |
| Surfactant amount: | 30 cc |
| Carrier oil type: | Amprol Type II (hydrocarbon oil), Lyondell, Houston, Texas |
| Carrier oil amount: | 300 cc |
| Grinding media: | Carbon Steel Balls |
| Grinding duration: | 24 hours |
| Ferrofluid | |
| Magnetization: | 20 Gauss |
| Viscosity: | 28 cp |
| Color: | Black |

EXAMPLE 6

| Processing values | |
|---|---|
| $\alpha$-$Fe_2O_3$ amount: | 30 gm |
| Surfactant type: | Neutral Calcium Petrosulphonate (calcium petroleum sulphonate), Penreco, Butler, Pennsylvania |
| Surfactant amount: | 20 cc |
| Carrier oil type: | Amprol Type II (hydrocarbon oil), Lyondell, Houston, Texas |
| Carrier oil amount: | 320 cc |
| Grinding media: | Carbon Steel Balls |
| Grinding duration: | 24 hours |
| Ferrofluid | |
| Magnetization: | 11 Gauss |
| Viscosity: | 29 cp |
| Color: | Light Brown |

EXAMPLE 7

| Processing values | |
|---|---|
| $\alpha$-$Fe_2O_3$ amount: | 30 gm |
| Surfactant type: | Hypermer B206 (non-ionic surfactant), ICI chemicals, Wilmington, Delaware |
| Surfactant amount: | 20 cc |
| Carrier oil type: | Amprol Type II (hydrocarbon oil), Lyondell, |

-continued

| | |
|---|---|
| | Houston, Texas |
| Carrier oil amount: | 320 cc |
| Grinding media: | Carbon Steel Balls |
| Grinding duration: | 24 hours |
| Ferrofluid | |
| Magnetization: | 14 Gauss |
| Viscosity: | 17 cp |
| Color: | Black-Brown |

EXAMPLE 8

| | |
|---|---|
| Processing values | |
| $\alpha$-$Fe_2O_3$ amount: | 30 gm |
| Surfactant type: | Oleic Acid (unsaturated fatty acid), Emery Chemicals, Cincinnati, Ohio |
| Surfactant amount: | 20 cc |
| Carrier oil type: | Amprol Type II (hydrocarbon oil), Lyondell, Houston, Texas |
| Carrier oil amount: | 320 cc |
| Grinding media: | Carbon Steel Balls |
| Grinding duration: | 24 hours |
| Ferrofluid | |
| Magnetization: | 22 Gauss |
| Viscosity: | 18 cp |
| Color: | Black |

EXAMPLE 9

| | |
|---|---|
| Processing values | |
| $\alpha$-$Fe_2O_3$ amount: | 30 gm |
| Surfactant type: | Variquat K300 (cationic surfactant - quaternary ammonium chloride), Witco Corporation, Dublin, Ohio |
| Surfactant amount: | 20 cc |
| Carrier oil type: | Amprol Type II (hydrocarbon oil), Lyondell, Houston, Texas |
| Carrier oil amount: | 320 cc |
| Grinding media: | Carbon Steel Balls |
| Grinding duration: | 24 hours |
| Ferrofluid | |
| Magnetization: | 8 Gauss |
| Viscosity: | 13 cp |
| Color: | Black-Brown |

EXAMPLE 10

| | |
|---|---|
| Processing values | |
| $\alpha$-$Fe_2O_3$ amount: | 30 gm |
| Surfactant type: | Solsperse 3000 (polymeric fatty ester), ICI Chemicals, Wilmington, Delaware |
| Surfactant amount: | 20 cc |
| Carrier oil type: | Amprol Type II (hydrocarbon oil), Lyondell, Houston, Texas |
| Carrier oil amount: | 300 cc |
| Grinding media: | Carbon Steel Balls |
| Grinding duration: | 24 hours |

-continued

| | |
|---|---|
| Ferrofluid | |
| Magnetization: | 17 Gauss |
| Viscosity: | 24 cp |
| Color: | Black-Brown |

EXAMPLE 11

| | |
|---|---|
| Processing values | |
| $\alpha$-$Fe_2O_3$ amount: | 30 gm |
| Surfactant type: | Solsperse 17000 (polymeric fatty ester), ICI Chemicals, Wilmington, Delaware |
| Surfactant amount: | 20 cc |
| Carrier oil type: | Amprol Type II (hydrocarbon oil), Lyondell, Houston, Texas |
| Carrier oil amount: | 300 cc |
| Grinding media: | Carbon Steel Balls |
| Grinding duration: | 24 hours |
| Ferrofluid | |
| Magnetization: | 17 Gauss |
| Viscosity: | 25 cp |
| Color: | Black-Brown |

EXAMPLE 12

| | |
|---|---|
| Processing values | |
| $\alpha$-$Fe_2O_3$ amount: | 30 gm |
| Surfactant type: | Vilax V-55A (acid modified ethylene $\alpha$-olefin copolymer), Vilax Corporation, Rockaway, New Jersey |
| Surfactant amount: | 20 cc |
| Carrier oil type: | Amprol Type II (hydrocarbon oil), Lyondell, Houston, Texas |
| Carrier oil amount: | 300 cc |
| Grinding media: | Carbon Steel Balls |
| Grinding duration: | 24 hours |
| Ferrofluid | |
| Magnetization: | 14 Gauss |
| Viscosity: | 47 cp |
| Color: | Brown |

EXAMPLE 13

| | |
|---|---|
| Processing values | |
| $\alpha$-$Fe_2O_3$ amount: | 20 gm |
| Surfactant type: | OS25569 (polyolefin anhydride), Lubrizol Corporation, Wickiffe, Ohio |
| Surfactant amount: | 10 cc |
| Carrier oil type: | Amprol Type II (hydrocarbon oil), Lyondell, Houston, Texas |
| Carrier oil amount: | 300 cc |
| Grinding media: | Carbon Steel Balls |
| Grinding duration: | 24 hours |
| Ferrofluid | |
| Magnetization: | 14 Gauss |
| Viscosity: | 24 cp |
| Color: | Black |

EXAMPLE 14

| Processing values | |
|---|---|
| $\alpha$-$Fe_2O_3$ amount: | 30 gm |
| Surfactant type: | Solsperse 3000 (polymeric fatty ester), ICI Chemicals, Wilmington, Delaware |
| Surfactant amount: | 20 cc |
| Carrier oil type: | Kessco 887 (ester oil), |
| Carrier oil amount: | 300 cc |
| Grinding media: | Carbon Steel Balls |
| Grinding duration: | 24 hours |
| Ferrofluid | |
| Magnetization: | 19 Gauss |
| Viscosity: | 63 cp |
| Color: | Black-Brown |

EXAMPLE 15

| Processing values | |
|---|---|
| $\alpha$-$Fe_2O_3$ amount: | 30 gm |
| Surfactant type: | Dow 2-8000 (amino functional siloxane), Dow Corning Chemical Corporation, Midland, Michigan |
| Surfactant amount: | 20 cc |
| Carrier oil type: | Dow 561 (silicone oil), Dow Corning Chemical Corporation, Midland, Michigan |
| Carrier oil amount: | 300 cc |
| Grinding media: | Carbon Steel Balls |
| Grinding duration: | 24 hours |
| Ferrofluid | |
| Magnetization: | 19 Gauss |
| Viscosity: | 49 cp |
| Color: | Brown |

EXAMPLE 16

| Processing values | |
|---|---|
| $\alpha$-$Fe_2O_3$ amount: | 30 gm |
| Surfactant type: | Solsperse 17000 (polymeric fatty ester), ICI Chemicals, Wilmington, Delaware |
| Surfactant amount: | 20 cc |
| Carrier oil type: | Kessco 887 (ester oil) |
| Carrier oil amount: | 300 cc |
| Grinding media: | Carbon Steel Balls |
| Grinding duration: | 24 hours |
| Ferrofluid | |
| Magnetization: | 18 Gauss |
| Viscosity: | 60 cp |
| Color: | Brown |

EXAMPLE 17

| Processing values | |
|---|---|
| $\alpha$-$Fe_2O_3$ amount: | 30 gm |
| Surfactant type: | Solsperse 17000 (polymeric fatty ester), ICI Chemicals, Wilmington, Delaware |
| Surfactant amount: | 20 cc |
| Carrier oil type: | Amprol type II (hydrocarbon oil), Lyondell, |

-continued

| | |
|---|---|
| | Houston, Texas |
| Carrier oil amount: | 300 cc |
| Grinding media: | Carbon Steel Balls |
| Grinding duration: | 24 hours |
| Ferrofluid | |
| Magnetization: | 18 Gauss |
| Viscosity: | 23 cp |
| Color: | Brown |

EXAMPLE 18

| Processing values | |
|---|---|
| $\alpha$-$Fe_2O_3$ amount: | 30 gm |
| Surfactant type: | Krytox 157 FSM (fluorinated surfactant), E. I. DuPont de Nemours & Co., Inc., Wilmington, Delaware |
| Surfactant amount: | 20 cc |
| Carrier oil type: | Krytox AB (fluorocarbon oil), E. I. DuPont de Nemours & Co., Inc., Wilmington, Delaware |
| Carrier oil amount: | 300 cc |
| Grinding media: | Carbon Steel Balls |
| Grinding duration: | 24 hours |
| Ferrofluid | |
| Magnetization: | 20 Gauss |
| Viscosity: | 123 cp |
| Color: | Brown |

EXAMPLE 19

| Processing values | |
|---|---|
| $\alpha$-$Fe_2O_3$ amount: | 30 gm |
| Surfactant type: | OS25569 (polyolefin anhydride), Lubrizol Corporation, Wickiffe, Ohio |
| Surfactant amount: | 20 cc |
| Carrier oil type: | Amprol Type II (hydrocarbon oil), Lyondell, Houston, Texas plus heptane |
| Carrier oil amount: | 100 cc (heptane 225 cc) |
| Grinding media: | Carbon Steel Balls |
| Grinding duration: | 40 hours |
| Ferrofluid | |
| Magnetization: | 29 Gauss |
| Viscosity: | 58 cp |
| Color: | Black |

In this example, heptane was added to the carrier oil to increase the magnetization of the ferrofluid. Heptane was periodically added to the attritor to make up for the loss which occurred during processing. After the colloid was formed, the heptane was removed by evaporation It is also possible to add small amounts of beneficial agent material to the slurry during processing to increase the magnetization of the resulting ferrofluid. This beneficial agent material can be a magnetic material, such as elemental iron powder. Alternatively, the beneficial agent can be water. Examples using these beneficial agents follow.

EXAMPLE 20

| Processing values | |
|---|---|
| $\alpha$-$Fe_2O_3$ amount: | 30 gm |
| Surfactant type: | OS25569 (polyolefin anhydride), Lubrizol Corporation, Wickiffe, Ohio |
| Surfactant amount: | 20 cc |
| Carrier oil type: | Amprol Type II (hydrocarbon oil), Lyondell, Houston, Texas |
| Carrier oil amount: | 300 cc |
| Beneficial Agt type: | Iron Powder |
| Beneficial Agt amt: | 5 gm |
| Grinding media: | Carbon Steel Balls |
| Grinding duration: | 24 hours |
| Ferrofluid | |
| Magnetization: | 30 Gauss |
| Viscosity: | 22 cp |
| Color: | Black |

When a small amount of iron powder was added to the slurry, the yield improved. A high magnetization and a low viscosity ferrofluid was obtained with black color. The quality of ferrofluid was judged to be superior.

EXAMPLE 21

| Processing values | |
|---|---|
| $\alpha$-$Fe_2O_3$ amount: | 45 gm |
| Surfactant type: | OS25569 (polyolefin anhydride), Lubrizol Corporation, Wickiffe, Ohio |
| Surfactant amount: | 30 cc |
| Carrier oil type: | Amprol Type II (hydrocarbon oil), Lyondell, Houston, Texas |
| Carrier oil amount: | 300 cc |
| Beneficial Agt type: | Iron Powder |
| Beneficial Agt amt: | 5 gm |
| Grinding media: | Carbon Steel Balls |
| Grinding duration: | 24 hours |
| Ferrofluid | |
| Magnetization: | 30 Gauss |
| Viscosity: | 29 cp |
| Color: | Black |

EXAMPLE 22

| Processing values | |
|---|---|
| $\alpha$-$Fe_2O_3$ amount: | 30 gm |
| Surfactant type: | OS25569 (polyolefin anhydride), Lubrizol Corporation, Wickiffe, Ohio |
| Surfactant amount: | 20 cc |
| Carrier oil type: | Amprol Type II (hydrocarbon oil), Lyondell, Houston, Texas plus heptane |
| Carrier oil amount: | 200 cc (heptane 100 cc) |
| Beneficial Agt type: | Iron Powder |
| Beneficial Agt amt: | 4 gm |
| Grinding media: | Carbon Steel Balls |
| Grinding duration: | 24 hours |
| Ferrofluid | |
| Magnetization: | 37 Gauss |
| Viscosity: | 41 cp |
| Color: | Black |

In this example, heptane as well as iron powder was added to the mixture to increase the yield. The mill was periodically topped off with heptane to make up for the loss which occurred during processing. After the run, heptane was evaporated from the resulting colloid to increase the magnetization.

EXAMPLE 23

| Processing values | |
|---|---|
| $\alpha$-$Fe_2O_3$ amount: | 30 gm |
| Surfactant type: | OS25569 (polyolefin anhydride), Lubrizol Corporation, Wickiffe, Ohio |
| Surfactant amount: | 20 cc |
| Carrier oil type: | Amprol Type II (hydrocarbon oil), Lyondell, Houston, Texas |
| Carrier oil amount: | 300 cc |
| Beneficial Agt type: | Water |
| Beneficial Agt amt: | 15 cc |
| Grinding media: | Carbon Steel Balls |
| Grinding duration: | 24 hours |
| Ferrofluid | |
| Magnetization: | 31 Gauss |
| Viscosity: | 20 cp |
| Color: | Black |

In this example, water was added to the mixture in the attritor as a beneficial agent to increase the chemical reactivity and promote the conversion of red iron oxide into its magnetic form.

EXAMPLE 24

| Processing values | |
|---|---|
| $\alpha$-$Fe_2O_3$ amount: | 45 gm |
| Surfactant type: | OS25569 (polyolefin anhydride), Lubrizol Corporation, Wickiffe, Ohio |
| Surfactant amount: | 30 cc |
| Carrier oil type: | Amprol Type II (hydrocarbon oil), Lyondell, Houston, Texas |
| Carrier oil amount: | 300 cc |
| Beneficial Agt type: | Water |
| Beneficial Agt amt: | 5 cc |
| Grinding media: | Carbon Steel Balls |
| Grinding duration: | 24 hours |
| Ferrofluid | |
| Magnetization: | 31 Gauss |
| Viscosity: | 30 cp |
| Color: | Black |

Many other carrier oil and surfactant combinations are possible which produce stable magnetic colloids of varying quality. Likewise, many other carriers, such as glycols, polyphenyl ethers, and silahydrocarbons together with compatible surfactants may be used to obtain stable magnetic colloids with the attrition mill.

Figure 2:
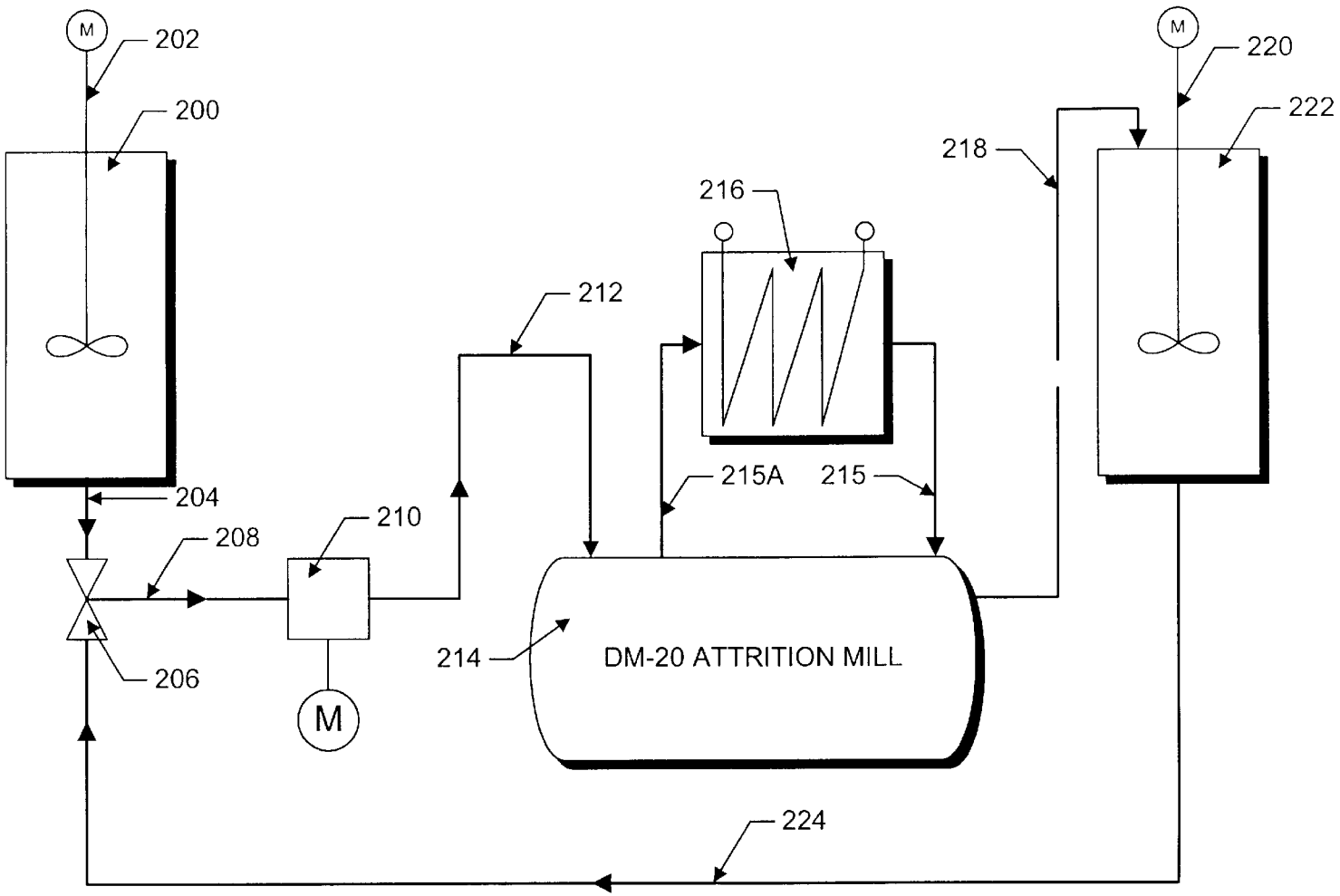
FIG. 2 is a process diagram of processing apparatus which can be used in either a batch mode or a continuous mode to produce ferrofluid in accordance with the inventive method.

The process illustrated in the above examples can be scaled to produce large volumes of ferrofluid using the apparatus shown in FIG. 2. When the model DM 01HD lab attrition mill is used, the materials used in the grinding process are directly poured into the vessel one by one through an opening. The shaft is first rotated at a slow speed to mix the materials and then it is increased for colloid formation. A larger attrition mill, model DM-20, manufactured by the aforementioned Union Process Company, Akron, Ohio, can also be used. When material is processed in the model DM-20 attrition mill, the process can be continuous or batched. In either case, a slurry of carrier oil, surfactant and red iron oxide is first pre-mixed in a large drum, such as a 55 gallon drum. The beneficial agent can also be added to the slurry at this time. Then the slurry is pumped into the attrition mill.

FIG. 2 is a process diagram of an illustrative apparatus for either batch or continuous production of ferrofluid in accordance with the inventive process. The oil, surfactant, red iron oxide and beneficial agent are added to the premix vessel 200 in the proper proportions as described below. An agitator 202 maintains the iron oxide suspended in the slurry. The slurry passes through outlet piping 204 to a valve 206 which directs the slurry, via piping 208, to a peristaltic pump 210.

From pump 210, the slurry passes, via piping 212, to the DM-20 attrition mill 214 where the slurry is ground in order to produce a stable colloid and to convert the non-magnetic iron oxide to its magnetic form. The mill 214 is connected, via piping 215 and 215A, to heat exchanger/cooler 216 which regulates the temperature of the mixture. The mixture then passes, via piping 218, to collection vessel 222. A second agitator 220 maintains the mixture in suspension. The mixture can be returned, via piping 224, to valve 206 and pump 210 for a second pass in the attrition mill 214 in case the desired magnetization has not been attained in a first pass through the attrition mill 214. Alternatively, the finished ferrofluid can be removed from collection vessel 222. When the apparatus is used in the batch mode, the pre-mixed slurry in vessel 200 is fed into the attrition mill 214 and ground. The resulting colloid is collected in the collection vessel 222. When all of the contents of vessel 200 have been processed by mill 214, the entire contents of vessel 222 are transferred back, via piping 224, to vessel 200 and the grinding process is repeated.

All the above examples involve a single surfactant. The shearing force of the grinding media converts the starting slurry into a stable magnetic colloid with the attachment of the surfactant to the bare surfaces of the particle. The attrition process can also be used to coat the already-coated particles with a second surfactant and then suspend them in a different carrier. For example, oleic acid coated particles may first be prepared in a suitable hydrocarbon solvent such as heptane, xylene or toluene using either the attritor process described above or the well-known co-precipitation technique of iron salt solutions. The coated particles are then dried in a closed evaporator in order to reclaim the solvent for later use. These dried and coated particles are then mixed with a second surfactant and a compatible oil carrier in the attritor to convert this mixture into a stable colloid by grinding. Alternatively, the first surfactant could be a polymeric succinic anhydride, or amine, or these materials could also be used as a second surfactant for oleic acid coated particles. With a suitable choice of the second surfactant, the coated particles may be suspended in a wide range of carrier oils such as hydrocarbon oils, esters, fluorocarbons and silicones, etc. For this process both red iron oxide converted into magnetic iron oxide by attrition as well as traditional magnetite particles coated with first surfactant may be employed.

The advantage of this approach is that the colloid can be prepared in a minimum time and, when the particles are dried, the solvent can be recycled. The conventional method of preparing such a colloid is to heat the solvent-based ferrofluid, consisting of the magnetic particles coated with the first surfactant and suspended in the solvent, in the presence of the carrier oil and second surfactant under constant agitation. This known process is very time consuming. Further, after the final doubly-coated colloid has been created, the solvent is typically removed by evaporation into the atmosphere, thereby adding to the cost. With the known techniques, it is not possible to first dry the magnetic particles in the solvent-based ferrofluid because the dried particles, when mixed with second surfactant and carrier oil, cannot form a complete colloid under agitation and heat. These particles must be milled in an attritor or a ball mill to impart sufficient energy to form the desired colloid.

Although only few illustrative embodiments have been disclosed, other embodiments will be apparent to those skilled in the art. For example, although particular hydrocarbons and other carriers have been disclosed in the examples, and only particular surfactants described, it is obvious that carriers having other compositions and surfactants or polymers of other types can be used. The surfactants may contain different polar groups or multiple polar groups. These modifications and others which will be apparent to those skilled in the art are intended to be covered by the following claims.

What is claimed is:

1. A method for making a ferrofluid, the method comprising the steps of:

(a) combining $\alpha$-$Fe_2O_3$ particles, a carrier liquid that is an oil suitable for forming a ferrofluid and a surfactant compatible with the carrier liquid to form slurry (b) bringing the slurry into contact with a beneficial agent which aids in the conversion of $\alpha$-$Fe_2O_3$ particles to magnetic iron oxide particles; and (c) subjecting the slurry to grinding with a media during step (b) to convert the $\alpha$-$Fe_2O_3$ particles to magnetic iron oxide particles.

2. The method as described in claim 1 wherein the liquid carrier is a hydrocarbon oil.

3. The method as described in claim 1 wherein the beneficial agent is a magnetic material.

4. The method as described in claim 3 wherein the beneficial agent is elemental iron.

5. The method as described in claim 1 wherein the beneficial agent is water.

6. The method as described in claim 1 wherein step (b) comprises the step of bringing the slurry into contact with steel grinding media balls.

7. The method as described in claim 1 wherein step (c) comprises the steps of:

(c2) placing the slurry in an attrition mill; and (c3) operating the attrition mill for a period of time sufficient to produce a ferrofluid.

8. A method for making a ferrofluid, the method comprising the steps of:

(a) combining particles of $\alpha$-$Fe_2O_3$ iron oxide, a hydrocarbon oil carrier liquid and a surfactant to form a slurry;

(b) placing the slurry in an attrition mill containing steel grinding media balls; and (c) operating the attrition mill for a period of time sufficient to produce a ferrofluid.

9. The method as described in claim 8 wherein step (a) further comprises the step of:

(a1) adding a beneficial agent which improves ferrofluid quality to the slurry.

10. The method as described in claim 9 wherein the beneficial agent is a magnetic material.

11. The method as described in claim 10 wherein the beneficial agent is elemental iron powder.

12. The method as described in claim 11 wherein step (a) further comprises the step of:

(a1) adding a beneficial agent which aids in the conversion of $\alpha$-$Fe_2O_3$ particles to magnetic iron oxide particles to the slurry.

13. The method as described in claim 8 wherein the hydrocarbon oil is Amprol Type II oil.

14. The method as described in claim 13 wherein the surfactant is a polyolefin anhydride.

* * * * *

UNITED STATES PATENT AND TRADEMARK OFFICE

CERTIFICATE OF CORRECTION

PATENT NO. : 6,068,785
DATED : May 30, 2000
INVENTOR(S) : Kuldip Raj, Lutful M. Aziz and Ronald E. Rosensweig It is certified that error appears in the above-identified patent and that said Letters Patent is hereby corrected as shown below:

Column 15,
Line 9, the claim reference numeral "11" should read -- 8 --.

Column 16,
Line 8, please insert the following claim:

15. The method as described in claim 9 wherein the beneficial agent is water.

Signed and Sealed this

Twelfth Day of February, 2002

*Attest:*

*Attesting Officer*

JAMES E. ROGAN
*Director of the United States Patent and Trademark Office*